United States Patent [19]

Le Grand et al.

[11] 4,372,444

[45] Feb. 8, 1983

[54] STACKABLE/NESTABLE/DIVIDABLE STORAGE BIN

[75] Inventors: Alexander J. Le Grand, Hartland; Richard A. Barnhouse, Watertown, both of Wis.

[73] Assignee: Menasha Corporation, Neenah, Wis.

[21] Appl. No.: 265,790

[22] Filed: May 21, 1981

[51] Int. Cl.[3] ..... B65D 21/04; B65D 25/06

[52] U.S. Cl. ..... 206/505; 206/509; 220/22.3

[58] Field of Search ..... 206/505, 506, 507, 508, 206/509; 220/22.3

[56] References Cited

U.S. PATENT DOCUMENTS

| | | | |
|---|---|---|---|
| Re. 26,350 | 2/1968 | Wilson . | |
| 403,683 | 5/1889 | Magruder . | |
| 1,037,912 | 9/1912 | Howard . | |
| 1,063,657 | 6/1913 | Choate . | |
| 1,221,631 | 4/1917 | Trout | 220/22.3 |
| 1,523,136 | 1/1925 | O'Connor | 220/22.3 |
| 2,081,078 | 5/1937 | Watson . | |
| 2,112,498 | 3/1938 | Lax . | |
| 2,221,024 | 11/1940 | Hood . | |
| 2,586,925 | 2/1952 | Drenberg | 220/22.3 |
| 2,596,995 | 5/1952 | Hamilton . | |
| 2,610,759 | 9/1952 | Slade | 220/22.3 |
| 2,788,912 | 4/1957 | Simonsen | 220/22.3 |
| 2,878,959 | 3/1959 | Nawman . | |
| 2,897,997 | 8/1959 | Sitler . | |
| 2,985,333 | 5/1961 | Kirkman . | |
| 3,200,983 | 8/1965 | Walter . | |
| 3,252,614 | 5/1966 | Evans . | |
| 3,259,269 | 7/1966 | Asenbauer . | |
| 3,347,394 | 10/1967 | Gould . | |
| 3,360,162 | 12/1967 | Miles . | |
| 3,379,341 | 4/1968 | Miles | 206/508 |
| 3,421,656 | 1/1969 | Asenbauer | 206/506 |
| 3,656,651 | 4/1972 | Hage . | |
| 3,734,309 | 5/1973 | Bateman . | |
| 3,791,528 | 2/1974 | Brendgord | 206/509 |
| 3,979,016 | 9/1976 | Frater | 206/508 |
| 4,015,713 | 4/1977 | Clipson et al. . | |
| 4,015,886 | 4/1977 | Wickenberg . | |
| 4,081,100 | 3/1978 | Presby . | |
| 4,093,070 | 6/1978 | Stahl . | |
| 4,093,071 | 6/1978 | Stahl et al. . | |
| 4,113,329 | 9/1978 | Thurman . | |
| 4,216,862 | 8/1980 | Daenen . | |

FOREIGN PATENT DOCUMENTS

| | | | |
|---|---|---|---|
| 1511383 | 12/1967 | France | 220/22.3 |
| 892677 | 3/1962 | United Kingdom . | |
| 1054715 | 1/1967 | United Kingdom | 206/506 |

OTHER PUBLICATIONS

Akro-Mils catalogue No. 7-1, Titled "Storage Products," marked "Copyright 1979".

*Primary Examiner*—George E. Lowrance
*Attorney, Agent, or Firm*—Quarles & Brady

[57] ABSTRACT

A stackable/nestable/dividable storage bin has an angled stacking tongue at its upper rear edge and a closed-end stacking channel at its lower rear edge. These are engageable with corresponding elements of like bins above or below so that two or more bins can be stacked, with the engagement of a tongue in a channel serving to limit relative vertical, longitudinal and lateral movement, and with lower side wall corners of an upper bin being received in rear wall notches of a lower bin for vertical positioning and added lateral support. The bin also has divider slots that extend behind and through stepped side wall portions to receive L flanges on the edges of a divider plate. Partially unsupported side wall portions serve as resilient lock tabs that bear against the divider flanges, and outer bosses that enclose the slots also serve as nesting stops engageable with the side wall steps of a lower bin.

4 Claims, 8 Drawing Figures

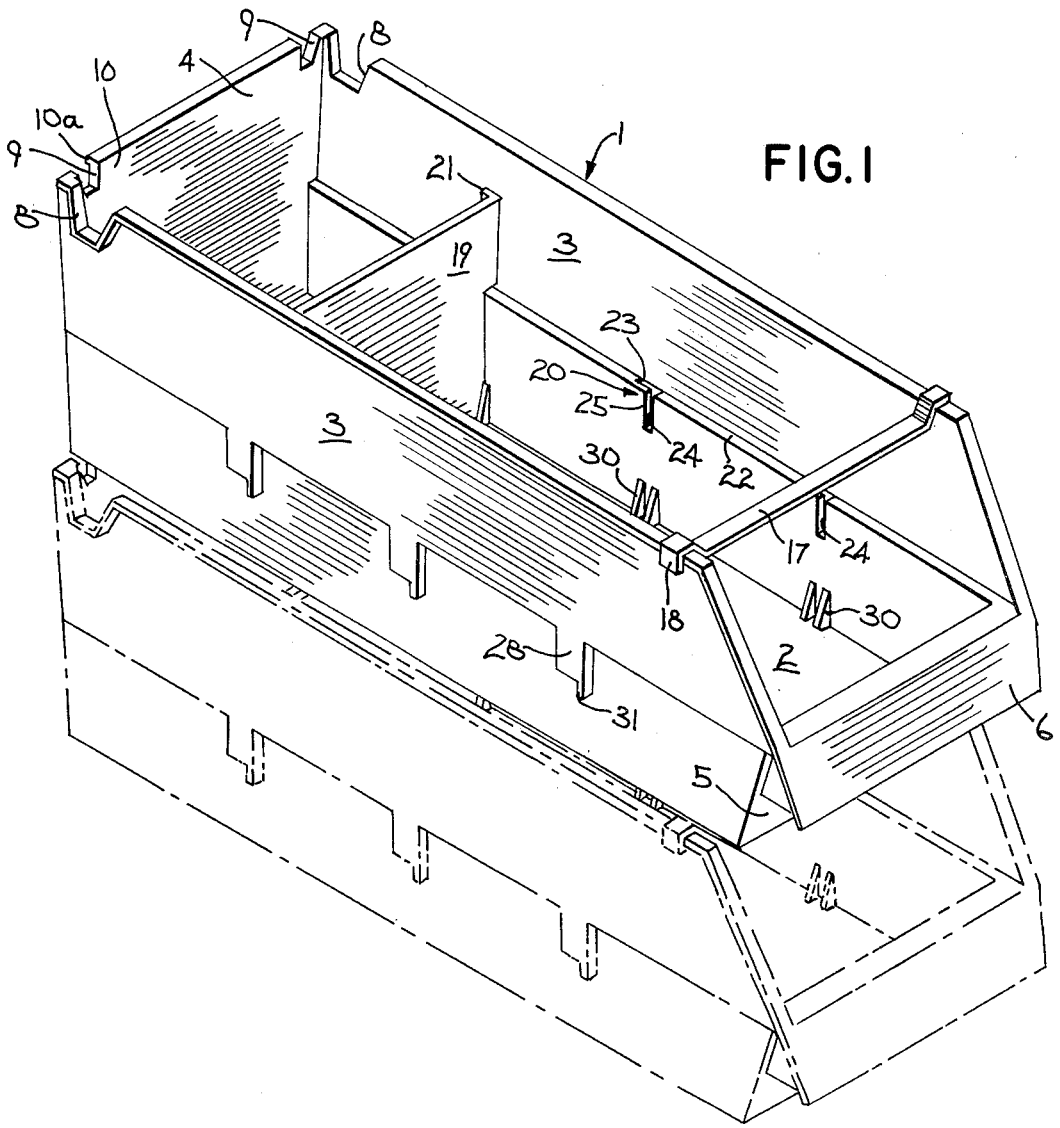
FIG. 1
FIG. 2
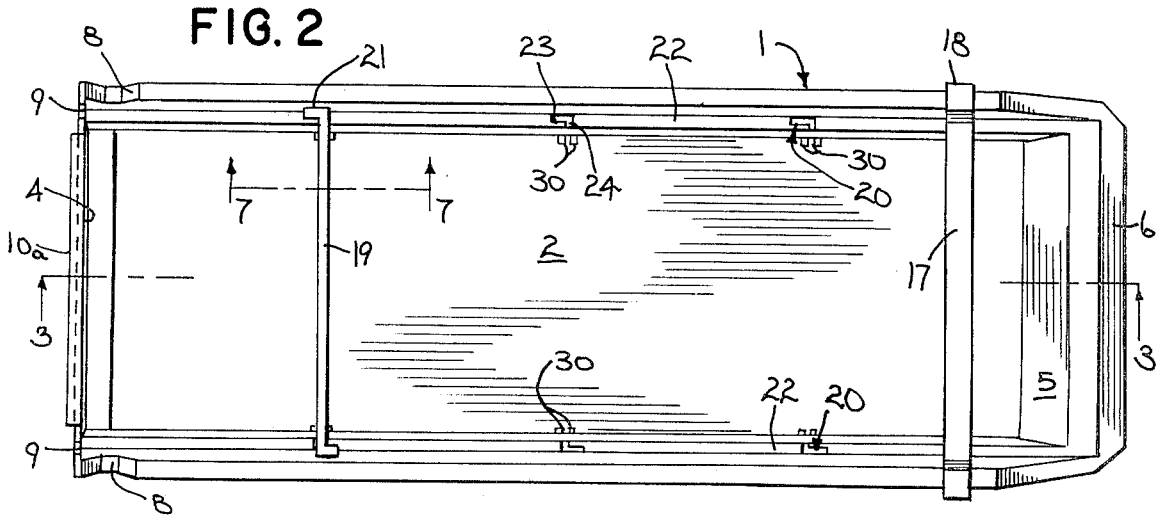

STACKABLE/NESTABLE/DIVIDABLE STORAGE BIN

BACKGROUND OF THE INVENTION

This invention relates to storage bins of the type used, for example, for the storage of small parts. It is important that such bins be easily and securely stackable for use in tiers, and also that they can be nested to reduce occupied space for shipment or storage. It is also very desirable that the bins be dividable into compartments so that, for example, several types or sizes of small parts can be kept in one bin, and it is important in this connection that the dividers be readily insertable and removable and that they remain securely in position to avoid mixing of items.

There are various bins available that are stackable, nestable, and/or dividable, but all known bins are deficient in one respect or another, for example in providing secure stacking, secure holding of the dividers, ease of use and/or simplicity of manufacture.

SUMMARY OF THE INVENTION

This invention provides a greatly improved stackable/nestable/dividable storage bin. Stacking is accomplished through an angled stacking tongue at the upper rear edge and a stacking channel at the lower rear edge, these being easily engageable and disengageable with corresponding elements on upper or lower bins to provide a simple but secure stacking connection. Engagement and disengagement are accomplished simply by lifting the front of an upper bin to an angle of about 45°, and the front end can be lifted slightly less, without disengagement, to allow improved access to a lower bin. Lower rear corners of the upper bin are received in notches in the rear wall of the lower bin for proper vertical positioning and to provide added lateral support. A convenient removable front support bar is provided that clips onto the side walls of the lower bin to support the forward end of an upper bin.

Dividability is provided by means of divider slots in stepped portions of the side walls that receive flanges at the edges of a divider. The side walls are resilient and normally spaced apart somewhat further than the width of the divider, but they can be moved together to accommodate the divider and then released to provide a resilient holding action. Side wall portions that actually engage the divider flanges are unsupported along two edges to provide resilient lock tabs that help insure that the divider is properly held in position. In the preferred embodiment, the divider has L flanges that extend in opposite directions so that the divider can be inserted in either of its front-rear orientations. The slots are outwardly enclosed by bosses on the outsides of the side walls, and extending portions of these serve as nesting stops engageable with the side wall steps of a lower bin.

The bin of the invention is highly effective, but is still relatively simple, inexpensive and easy to manufacture and use. It can readily be molded using conventional plastic materials.

The foregoing and other objects and advantages will be apparent from the description to follow.

BRIEF DESCRIPTION OF THE DRAWINGS

FIG. 1 is a view in perspective showing a storage bin constituting a preferred embodiment of the invention, a lower bin on which it is stacked being shown in broken lines;

FIG. 2 is a top plan view of the bin of FIG. 1;

DESCRIPTION OF THE PREFERRED EMBODIMENT

Figure 3:
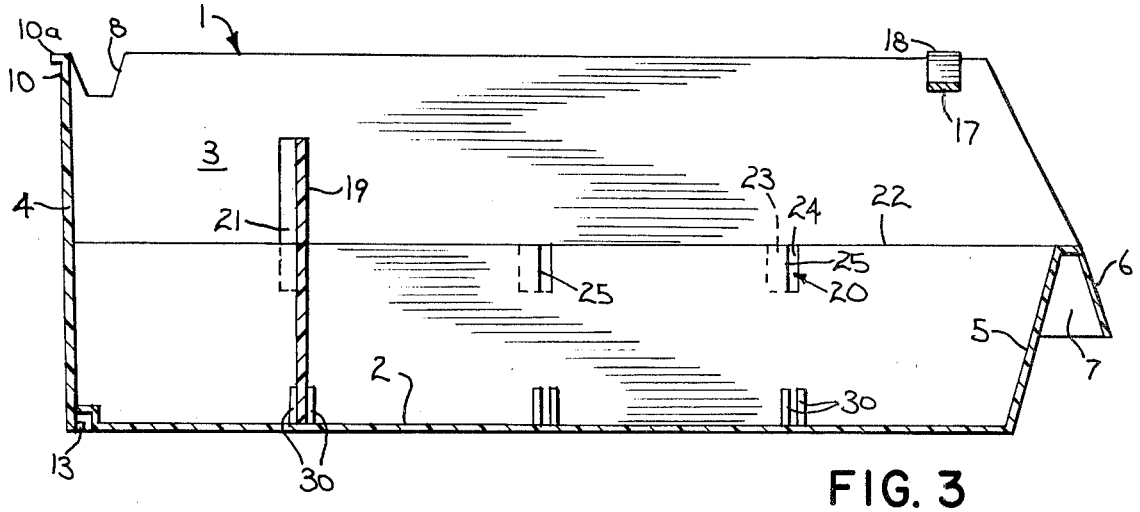
FIG. 3 is a longitudinal view in cross section through the plane 3—3 shown in FIG. 2.

The bin shown in the drawings is of conventional overall configuration, and it is designated generally by the reference numeral 1. It includes a horizontal bottom wall 2, opposite side walls 3 that are generally vertical and parallel but angle outwardly and diverge slightly from bottom to top, a vertical rear wall 4, and a front wall 5. The front wall 5 is angled forwardly from bottom to top and extends only partially up the side walls 3 to provide access to the interior of the bin 1 in usual fashion. A handle 6 is formed at the top of the front wall 5 and is supported by longitudinally extending ribs 7 connected between it and the front wall 5. The side walls 3 are provided at the rear of their upper edges with conventional racking or shelving notches 8. The bin 1 is preferably molded as a single piece from any suitable resilient plastic material known to those skilled in the art.

The horizontal upper edge of the rear wall 4 is shaped to define stacking notches 9 near its lateral extremities. The central portion between the notches 9 constitutes a stacking tongue 10 and is shaped to define a rearwardly extending horizontal lip **10*a* which gives it an angled configuration. Due to the inclination of the side walls 3, the upper edge of the rear wall 4 is longer than its lower edge, and the length of the tongue 10** corresponds to the length of the lower edge.

The lower rear edge of the bin 1 is inset to define a vertical front surface 11 that leads upwardly from the bottom wall 2 and is parallel to and forwardly spaced from the rear wall 4, and a horizontal top surface 12 that leads rearwardly from the top edge of the surface 11 to the rear wall 4 and is parallel to and upwardly spaced from the bottom wall 2. The surfaces 11 and 12 extend transversely across the entire width of the bin 1. The lower edge **4*a* of the rear wall 4 extends downwardly from the rear edge of the surface 12 to the level of the bottom wall 2, and constitutes a vertical rear surface that faces and is parallel to and spaced rearwardly of the surface 11. A forwardly extending horizontal hook flange 13 extends from the bottom edge of the portion 4*a* toward the abutment 11, but stops short thereof, and constitutes a horizontal bottom surface parallel to and spaced below the surface 12 and at the level of the bottom wall 2. The hook flange 13 is formed as two separated portions extending inwardly from respective sides of the rear wall 4 and the side walls 3, with tool openings 14 of equal length extending through the lower edge 4a above them. The hook flange 13, the rear surface 4a, and the surfaces 11 and 12 together define a transverse stacking channel 15 that extends across the bin 1 and is closed off at its ends by the lower rear corners of the side walls 3. The space 16 between the forward edge of the flange 13 and the surface 11 constitutes a stacking slot affording access to the channel 15, the slot 16 being narrower than the front to rear dimension of the lip 10a. The particular configuration shown is preferred for efficiency and ease of molding, but modifications are possible. If desired, for example, the hook flange 13 could be continuous across the width of the bin 1 and/or the ends of the channel 15** could be open. The rear surface and hook flange need not be in direct alignment with the rear wall and bottom wall as shown, and other configurations such as a continuous curved surface could be used to effectively provide the same channel and surfaces.

Figure 6:
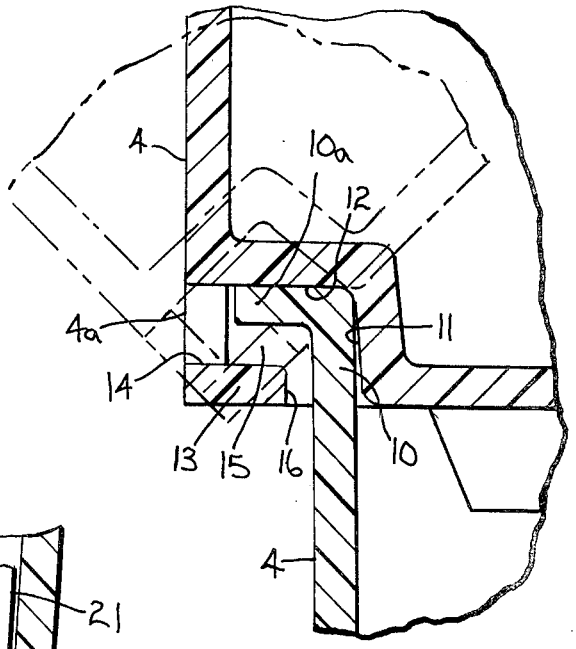
FIG. 6 is an enlarged fragmentary view in cross section through the plane 6—6 shown in FIG. 4, with an alternative position of the upper bin shown in broken lines.

The stacking channel 15 will receive the stacking tongue 10 of a like bin 1 below for stacking, as best illustrated by FIG. 6. If the front end of the upper bin is tipped upwardly about 45°, as shown in broken lines in FIG. 6, the lip 10a of the lower bin can enter the channel 15 through the slot 16. Subsequent lowering of the upper bin to a horizontal position will bring the elements to the position shown in full lines in FIG. 6, wherein the upper surface of the hook flange 13 of the upper bin is under the lip 10a of the lower bin to prevent the rear end of the upper bin from being lifted upwardly more than a slight amount. At the same time, the stacking tongue 10 including the lip 10a vertically supports the top surface 12 and is engageable with the surfaces 11 and 4a to limit relative longitudinal movement. Relative lateral movement is limited by engagement of the ends of the stacking tongue 10 with the inner surfaces of the lower rear side wall corners of the upper bin. The lower rear side wall corners are disposed in the notches 9, which provides proper vertical positioning for the upper bin and also provides added lateral support. The upper bin can be disengaged from the lower bin by tipping the front end upwardly again to about 45°, whereupon the lip 10a can pass through the slot 16. The forward end of the upper bin can be tilted less than about 45° without disengagement, and this allows for easier access to the lower bin if desired.

It is obvious that the forward end of the upper bin 1 must also be supported, and in the preferred embodiment this is accomplished by using a support member in the form of a removable, resilient metal support bar 17 shaped at its ends to define clips 18 that releaseably grip the flanged upper edges of the side walls 3 of the lower bin. The bar 17 can be placed at any desired longitudinal location, but will usually be well toward the forward end of the lower bin in a position where it will engage with and support the forward end of the bottom wall 2 of the upper bin, as shown in FIG. 1. Other known support means, such as headed rods extending through apertures in the side walls, could be substituted.

The preferred bin 1 is adapted to be divided into up to four longitudinally arrayed compartments by means of dividers 19, only one of which is shown. The divider 19 is essentially a relatively rigid, sheet-like partition, preferably plastic, that spans the distance between the side walls 3 to divide the interior of the bin 1. Dividers can be placed at any one or more of three locations defined by respective, opposed pairs of transversely aligned divider slots 20 longitudinally spaced along the side walls 3.

The opposite vertical side edges of the divider 19 are slightly divergent from bottom to top to match the inclination of the side walls 3, and are provided, beginning at approximately their vertical mid-points and extending upwardly therefrom, with perpendicular, longitudinally extending lock flanges 21. In the preferred embodiment, these are perpendicular L flanges to prevent pull-through, and they extend in opposite directions so that the divider can be inserted with either of its major surfaces facing forwardly or rearwardly. The flanges 21 could, however, both extend in the same direction, or T-flanges could be used. The flanges 21 could extend along less or more of the vertical lengths of the side edges of the divider 19, but they preferably run from a point corresponding to the bottoms of the slots 20 to at least a point corresponding to the levels of the side wall ledges 22 described below.

The side walls 3 are stepped outwardly beginning at about their vertical midpoints to define opposite, vertically aligned, horizontal ledges or steps 22 in which the slots 20 are formed as will be described, the stepped configuration also serving to strengthen the side walls 3. As seen most clearly in FIG. 2, each slot 20 comprises a longitudinally extending flange portion 23 that extends upwardly through the step 22 and downwardly behind the lower portion of the side wall 3, below the step 22, and a transversely extending divider portion 24 that extends from the portion 23 through the side wall 3 into the interior of the bin 1. This configuration leaves generally rectangular portions 25 of the lower parts of the side walls 3 that overlay the slot flange portions 23 and that are each unsupported along a horizontal edge 26 running along the flange portion 23 and an adjacent vertical edge 27 running along the portion 24, the portions 25 serving as resilient lock tabs as will be described.

The slots 20 are outwardly enclosed by bosses 28, the major vertical surfaces of which are essentially continuations of the upper portions of the side walls 3 and that have bottom walls 29 that define the bottoms of the slots 20.

Figure 7:
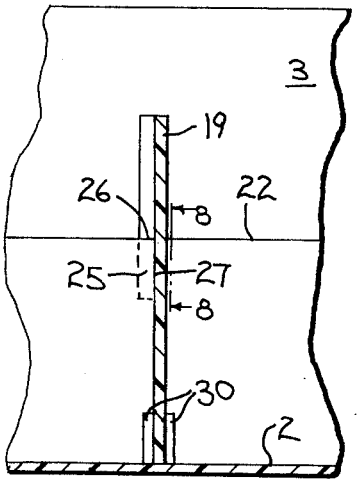
FIG. 7 is a somewhat enlarged fragmentary view in cross section through the plane 7—7 shown in FIG. 2.
Figure 8:
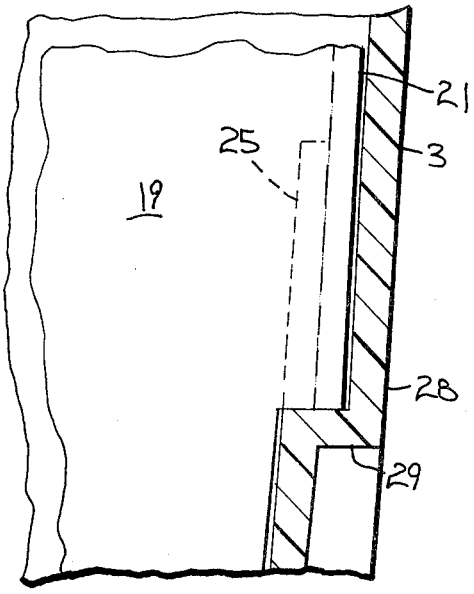
FIG. 8 is a further enlarged fragmentary view in cross section through the plane 8—8 shown in FIG. 7.

As seen in FIGS. 2, 7 and 8, when a divider 19 is inserted in a respective pair of slots 20, the flanges 21 are received in the slot flange portions 23, with the edges of the divider proper being received through the divider portions 24. The lower edges of the flanges 21 rest on the walls 29 and the bottom edge of the divider 19 rests on the bottom wall 2. To provide additional longitudinal support for the bottom edge of the divider 19, pairs of spaced ribs 30 are formed at the bottoms of the side walls 3 in vertical alignment with respective slots 20, and the bottom corners of the divider 19 are received between the members of respective pairs of ribs 30.

With proper dimensioning, the arrangement as thus described will itself provide suitable holding of the divider 19, but the invention provides valuable additional security through the use of a resilient engagement. The side walls 3 are normally spaced apart a distance somewhat greater than the width of the divider 19, or in other words the transverse distance between the flanges 21, but because of their resilience the walls 3 can be manually moved together to accommodate the divider 19 and then released. When this is done, the resilient, and only partially supported, lock tabs 25 bear against the inner surfaces of the flanges 21 to provide a secure frictional engagement that prevents vertical movement of the divider 19 under all normal circumstances.

Figure 4:
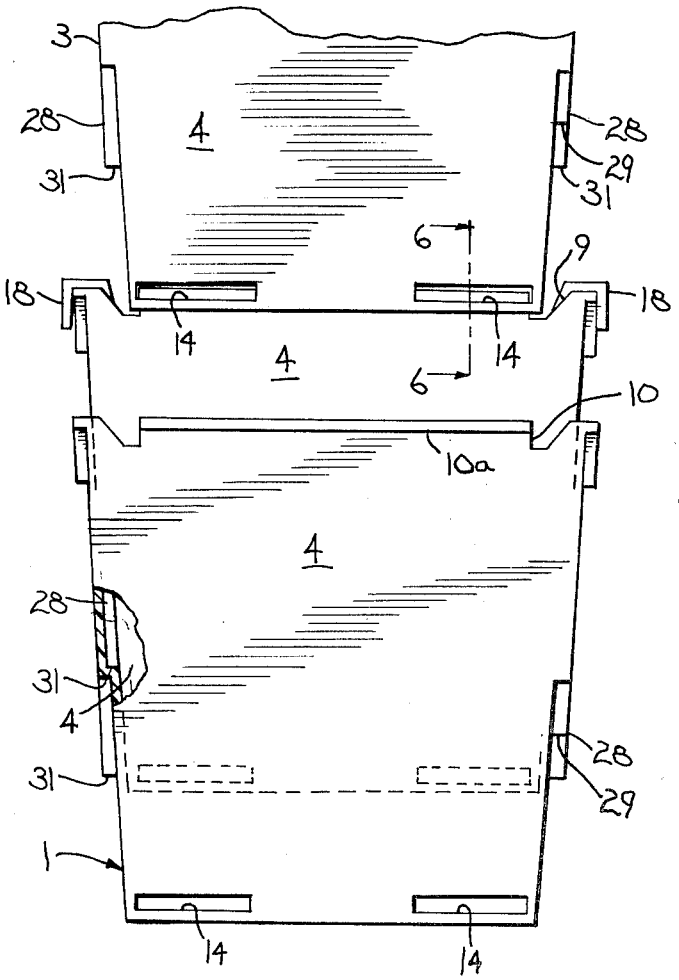
FIG. 4 is a rear view in elevation of the bin of FIG. 1, also showing for illustrative purposes a portion of a like upper bin stacked on it, and a like lower bin within which it is nested.
Figure 5:
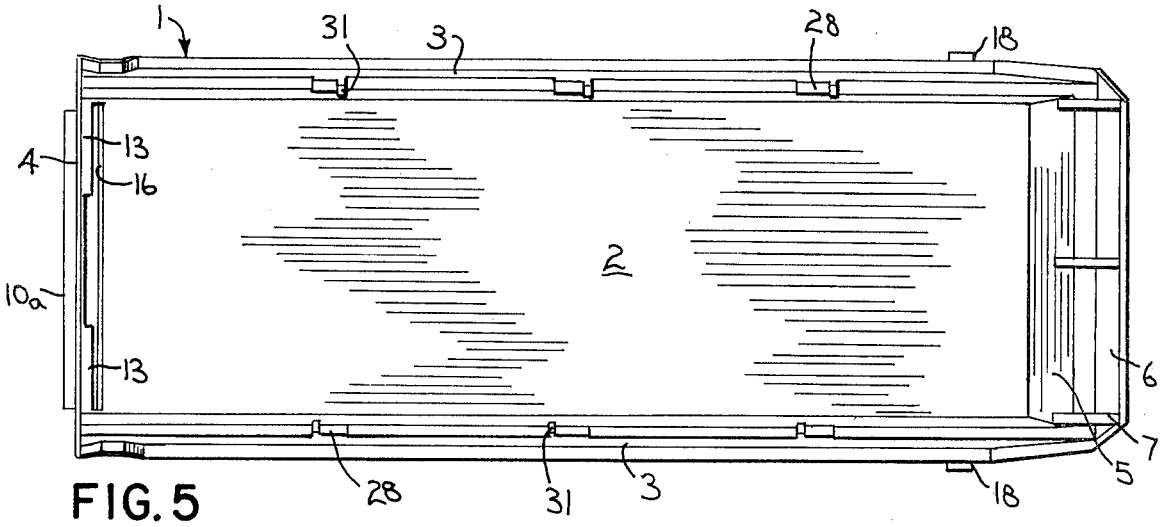
FIG. 5 is a bottom plan view of the bin of FIG. 1.

As previously indicated, the side walls 3 diverge from bottom to top, which means that the width of the bottom wall 2 is less than the distance between the top edges of the side walls 3. This allows two bins 1 to be nested, and the steps 22 and bosses 28 provide a convenient nesting stop arrangement, the bosses being engageable with the steps to limit downward movement of the upper bin 1, all as seen in FIG. 4. (The arrangement shown in FIG. 4, where one bin is stacked on two nested bins, is not one that would ordinarily be used, but is shown to illustrate stacking and nesting capabilities.) In the preferred embodiment shown, the actual engagement of the steps 22 is by extension ribs 31 that form part of the bosses 28, although the major portions of the bosses 28 could be extended downwardly far enough to serve the same purpose.

The preferred embodiment described provides easy and secure stacking, dividability, and nesting while still being relatively simple and inexpensive to manufacture. A preferred embodiment has been shown and described, but it will be obvious that various modifications, such as changes in the specific configuration of the stacking tongue and stacking channel, and the use of T-flanges on the dividers, could be made without departure from the spirit of the invention. The invention is, therefore, not intended to be limited by the showing or description herein, or in any other manner, except insofar as may specifically be required.

We claim:

1. In a storage bin having a horizontal bottom wall, vertical side walls, and a vertical rear wall that has horizontal upper and lower edges, the side walls being outwardly inclined from bottom to top with the lower edge of the rear wall being correspondingly shorter than its upper edge, the improvement wherein:

a central part of the upper edge of the rear wall that corresponds to the length of the lower edge of the rear wall constitutes a stacking tongue including a rearwardly extending lip; the upper rear wall edge has downwardly extending stacking notches at the ends of the stacking tongue; the lower rear edge of the bin defines a transverse stacking channel extending across the length of the lower rear wall edge, said stacking channel comprising front, top and rear surfaces and a bottom surface in the form of a hook flange that leads toward but stops short of the front surface to define a stacking slot that is narrower than the front to rear dimension of the lip, the stacking slot being capable when the front of the bin is tipped upwardly of admitting the stacking tongue of a like bin below into the stacking channel, return of the upper bin to horizontal then putting the elements in a position where the stacking tongue of the lower bin supports the top surface of the stacking channel of the upper bin and is engageable with the other surfaces thereof to limit relative vertical and longitudinal movement of the bins; and the side walls have lower rear corner portions that close off the ends of the stacking channel and are disposed in respective stacking notches when the bin is stacked with a like bin below.

2. In a storage bin having opposite vertical side walls that are outwardly inclined from bottom to top to allow the bin to be nested in a like bin below, and at least one insertable and removable divider comprising a sheet-like partition that has vertical edges facing respective side walls and that extends transversely between the side walls to divide the bin into compartments, the improvement wherein:

the upper portions of the side walls are stepped outwardly to define opposite horizontal steps; there is at least one pair of opposed divider slots, one in each side wall, each slot comprising a longitudinally extending flange portion that extends upwardly through the step and downwardly behind the portion of the side wall below the step and a divider portion that extends inwardly from the flange portion through the side wall; the divider has lock flanges extending transversely from its edges longitudinally of the bin, the divider being received in the bin with the lock flanges in the flange portions of the slots and the divider proper extending through the divider portions; and there are bosses on the outsides of the lower portions of the side walls at the divider slots, said bosses serving to define and enclose the outer limits of the slots and also serving as nesting stops engageable with the side wall steps of a like bin below.

3. A storage bin according to claim 2, wherein:

the side walls are resilient and are normally spaced such that the transverse distance between the divider slots is greater than the distance between the lock flanges, but the side walls can be manually moved together to accommodate the lock flanges; and the portion of the side wall that overlays the flange portion of each divider slot is unsupported along adjacent edges that border the upper opening of the flange portion and the divider portion, such side wall portions constituting lock tabs that resiliently bear against the lock flanges to hold the divider in place when the side walls are moved together to accommodate the flanges and then released.

4. In a storage bin having a horizontal bottom wall, vertical side walls that are outwardly inclined from bottom to top to allow the bin to be nested in a like bin below, and a vertical rear wall that has horizontal upper and lower edges, the improvement wherein:

at least part of the upper edge of the rear wall constitutes a stacking tongue including a rearwardly extending lip; the lower rear edge of the bin defines a transverse stacking channel extending at least partially across the bin, said stacking channel comprising front, top and rear surfaces and a bottom surface in the form of a hook flange that leads toward but stops short of the front surface to define a stacking slot that is narrower than the front to rear dimension of the lip, the stacking slot being capable when the front of the bin is tipped upwardly of admitting the stacking tongue of a like bin below into the stacking channel, return of the upper bin to horizontal then putting the elements in a position where the stacking tongue of the lower bin supports the top surface of the stacking channel of the upper bin and is engageable with the other surfaces thereof to limit relative vertical and longitudinal movement of the bins, said stacking channel further including closed ends engageable with the ends of the stacking tongue of a lower bin when the bins are stacked upon one another to limit the relative movement of the bins along a line parallel to the upper and lower rear edges of the bins, and there is a removable transverse support member near the front of the bin that extends between the tops of the side walls and serves as a support engageable with the forward portion of the bottom wall of a like bin stacked above, said support member and the engagement of the stacking tongue of the lower bin in the stacking channel of the upper bin together serving as substantially the only support for the upper bin.

* * * * *